US009045857B2

(12) United States Patent
Gomi et al.

(10) Patent No.: US 9,045,857 B2
(45) **Date of Patent: *Jun. 2, 2015**

(54) SHEET MANUFACTURING APPARATUS

(71) Applicant: SEIKO EPSON CORPORATION, Tokyo (JP)

(72) Inventors: Katsuhito Gomi, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/224,377

(22) Filed: Mar. 25, 2014

(65) Prior Publication Data

US 2014/0290887 A1 Oct. 2, 2014

(30) Foreign Application Priority Data

Mar. 27, 2013 (JP) ..... 2013-065807
Feb. 13, 2014 (JP) ..... 2014-025122

(51) Int. Cl.
*D21F 1/48* (2006.01)
*D21B 1/06* (2006.01)

(52) U.S. Cl.
CPC ..... *D21B 1/063* (2013.01); *D21B 1/068* (2013.01)

(58) Field of Classification Search
USPC ..... 162/252, 261, 4
See application file for complete search history.

(56) References Cited

U.S. PATENT DOCUMENTS

2014/0027075 A1* 1/2014 Yamagami et al. ..... 162/4

FOREIGN PATENT DOCUMENTS

EP 2664708 A1 11/2013
JP 2012-144819 A 8/2012

OTHER PUBLICATIONS

JP-2011-005573, Yamagami et al., Feb. 2012.*

* cited by examiner

*Primary Examiner* — Mark Halpern
(74) *Attorney, Agent, or Firm* — Global IP Counselors, LLP

(57) ABSTRACT

A sheet manufacturing apparatus includes a defibrating unit configured to defibrate a defibration object, a measuring unit configured to acquire information relating to the moisture contained in the defibration object, and a controller configured to modify an operating condition of the defibrating unit based on the information.

4 Claims, 6 Drawing Sheets

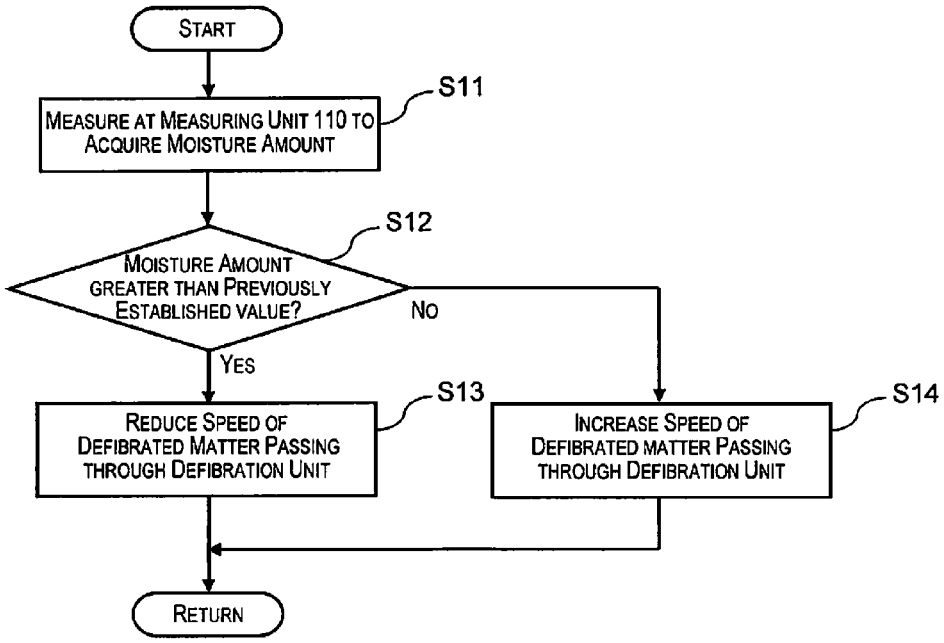

Fig. 6

| DEFIBRATION ROTATIONAL SPEED [rpm] | WATER CONTENT RATIO [%] OF FED STOCK MATERIAL | | | |
|---|---|---|---|---|
| | 4.2 | 5.1 | 6.8 | 8.0 |
| 2000 | ○ | FIBER CLUMPING | FIBER CLUMPING | FIBER CLUMPING |
| 3000 | ○ | ○ | ○ | FIBER CLUMPING |
| 4000 | SHORT FIBERS | SHORT FIBERS | ○ | ○ |
| 5000 | SHORT FIBERS | SHORT FIBERS | SHORT FIBERS | ○ |

Fig. 7

| DAMPER OPENING RATE [%] (PROPORTIONAL TO EXHAUST AMOUNT) | WATER CONTENT RATIO [%] OF FED STOCK MATERIAL | | | |
|---|---|---|---|---|
| | 4.2 | 5.1 | 6.8 | 8.0 |
| 10 | SHORT FIBERS | SHORT FIBERS | ○ | ○ |
| 40 | SHORT FIBERS | ○ | ○ | FIBER CLUMPING |
| 70 | SHORT FIBERS | ○ | FIBER CLUMPING | FIBER CLUMPING |
| 100 | ○ | ○ | FIBER CLUMPING | FIBER CLUMPING |

Fig. 8

SHEET MANUFACTURING APPARATUS

CROSS-REFERENCE TO RELATED APPLICATIONS

This application claims priority to Japanese Patent Application No. 2013-065807 filed on Mar. 27, 2013 and Japanese Patent Application No. 2014-025122 filed on Feb. 13, 2014. The entire disclosure of Japanese Patent Application Nos. 2013-065807 and 2014-025122 is hereby incorporated herein by reference.

BACKGROUND

1. Technical Field

The present invention relates to a sheet manufacturing apparatus.

2. Related Art

Used paper discharged from offices has conventionally also included used paper on which confidential matters have been written, and therefore in terms of maintaining confidentiality, the ability to process used paper in one's own office has also long been desired. Because wet-type sheet manufacturing apparatuses, which consume large amounts of water, are not suitable in small-scale offices, sheet manufacturing apparatuses according to a structurally simplified dry type have been proposed (for example, see Japanese Unexamined Laid-open Patent Publication No. 2012-144819).

However, the sheets manufactured by such sheet manufacturing apparatuses have had problems in that short fibers are included and this results in insufficient strength, and fiber clumping (fiber aggregates) end up resulting in surface unevenness.

SUMMARY

Having been created in order to resolve the above-mentioned problems at least in part, the present invention can be implemented as the aspects and application examples described below.

A sheet manufacturing apparatus according to an aspect of the invention includes a defibrating unit configured to defibrate a defibration object, a measuring unit configured to acquire information relating to moisture contained in the defibration object, and a controller configured to modify an operating condition of the defibrating unit based on the information.

The fact that the extent of moisture contained in the defibration object results in different results of defibration has been demonstrated to cause inadequate strength of the manufactured sheets as well as incorporation of fiber clumps (fiber aggregates). As such, according to the sheet manufacturing apparatus of the above configuration, detecting the information about the moisture contained in the defibration object and modifying the operating condition of the defibrating unit on the basis of the detected information about moisture makes it possible to eliminate inadequate sheet strength and possible to produce sheets with which incorporation of fiber clumps has been reduced.

According to another aspect of the invention, the sheet manufacturing apparatus is characterized in that the defibrating unit has a rotating blade configured to defibrate the defibration object, and the controller controls the defibrating unit such that a pressure applied to the defibration object while the defibration object passes through the defibrating unit and when the moisture amount contained in the defibration object is a first case is greater than a pressure applied to the defibration object while the defibration object passes through the defibrating unit and when the moisture amount contained in the defibration object is less than the first case.

According to the sheet manufacturing apparatus of this configuration, the defibration object is more defibrated because in a case where a greater moisture amount is contained in the defibration object, the pressure applied to the defibration target is greater than a case where a lesser moisture amount is contained. This makes it possible to reduce the occurrence of fiber clumping. In turn, in a case where a lesser moisture amount is contained in the defibration object, the pressure applied to the defibration object is less than a case where a greater moisture amount is contained, and therefore the extent of defibration of the defibration object is reduced, due to the fact that the number of times where the rotating blade hits against the defibration object is reduced. This eliminates a state of excessive defibration, reduces the occurrence of short fibers, and makes it possible to prevent the occurrence of inadequate sheet strength.

According to another aspect of the invention, the sheet manufacturing apparatus is characterized in that a rotational speed of the rotating blade when the moisture amount contained in the defibration object is the first case is greater than a rotational speed of the rotating blade when the moisture amount contained in the defibration object is less than the first case.

According to the sheet manufacturing apparatus of this configuration, in a case where a greater moisture amount is contained in the defibration object, the rotational speed of the rotating blade is increased to be greater than a case where a less moisture amount is contained. So doing causes the defibration object to be more defibrated, because the number of times where the rotating blade hits against the defibration object is increased. This makes it possible to reduce the occurrence of fiber clumping. In turn, in a case where a lesser moisture amount is contained in the defibration object, the rotational speed of the rotating blade is reduced to be less than a case where a greater moisture amount is contained. So doing reduces the extent of defibration of the defibration object, because the number of times where the rotating blade hits against the defibration object is reduced. This eliminates a state of excessive defibration, reduces the occurrence of short fibers, and makes it possible to prevent the occurrence of inadequate sheet strength.

According to another aspect of the invention, the sheet manufacturing apparatus is characterized in that a speed at which the defibration object passes through the defibrating unit when the moisture amount contained in the defibration object is the first case is less than the speed at which the defibration object passes through the defibrating unit when the moisture amount contained in the defibration object is less than the first case.

According to the sheet manufacturing apparatus of this configuration, in a case where a greater moisture amount is contained in the defibration object, the speed at which the defibration object passes through the defibrating unit is reduced to less than a case where the a lesser moisture amount is contained. That is to say, the movement speed of the defibration object passing through the defibrating unit is reduced. So doing causes the defibration object to be more defibrated, because the number of times where the rotating blade hits against the defibration object is increased. This makes it possible to reduce the occurrence of fiber clumping. In turn, in a case where a lesser moisture amount is contained in the defibration object, the speed at which the defibration object passes through the defibrating unit is increased to more than a case where a greater moisture amount is contained. That is to say, the movement speed of the defibration object passing through the defibrating unit is lowered. So doing reduces the extent of defibration of the defibration object, because the number of times where the rotating blade hits against the defibration object is reduced. This eliminates a state of excessive defibration, reduces the occurrence of short fibers, and makes it possible to prevent the occurrence of inadequate sheet strength.

BRIEF DESCRIPTION OF THE DRAWINGS

Referring now to the attached drawings which form a part of this original disclosure:

FIG. 6 is a flow chart illustrating a control as in the second embodiment;

FIG. 7 is a drawing illustrating a state of defibration as in a first example; and FIG. 8 is a drawing illustrating a state of defibration as in a second example.

DETAILED DESCRIPTION OF EXEMPLARY EMBODIMENTS

A first and second embodiment of the present invention shall be described below with reference to the accompanying drawings. In each of the drawings given below, the scale of the respective members and the like has been illustrated differently from the actual scale, in order to increase the size of respective members and the like to such an extent as to be visually recognizable.

First Embodiment

First, the configuration of a sheet manufacturing apparatus shall be described.

The sheet manufacturing apparatus is a device provided with a defibrating unit for defibrating a defibration object, a measuring unit for acquiring information relating to the moisture contained in the defibration object, and a controller for modifying an operating condition of the defibrating unit. Examples of stock materials serving as the defibration object supplied to the sheet manufacturing apparatus as in the present embodiment include pulp sheets or used paper PU of the A4 size that currently predominates in offices, or the like. The following provides a more detailed description.

Figure 1:
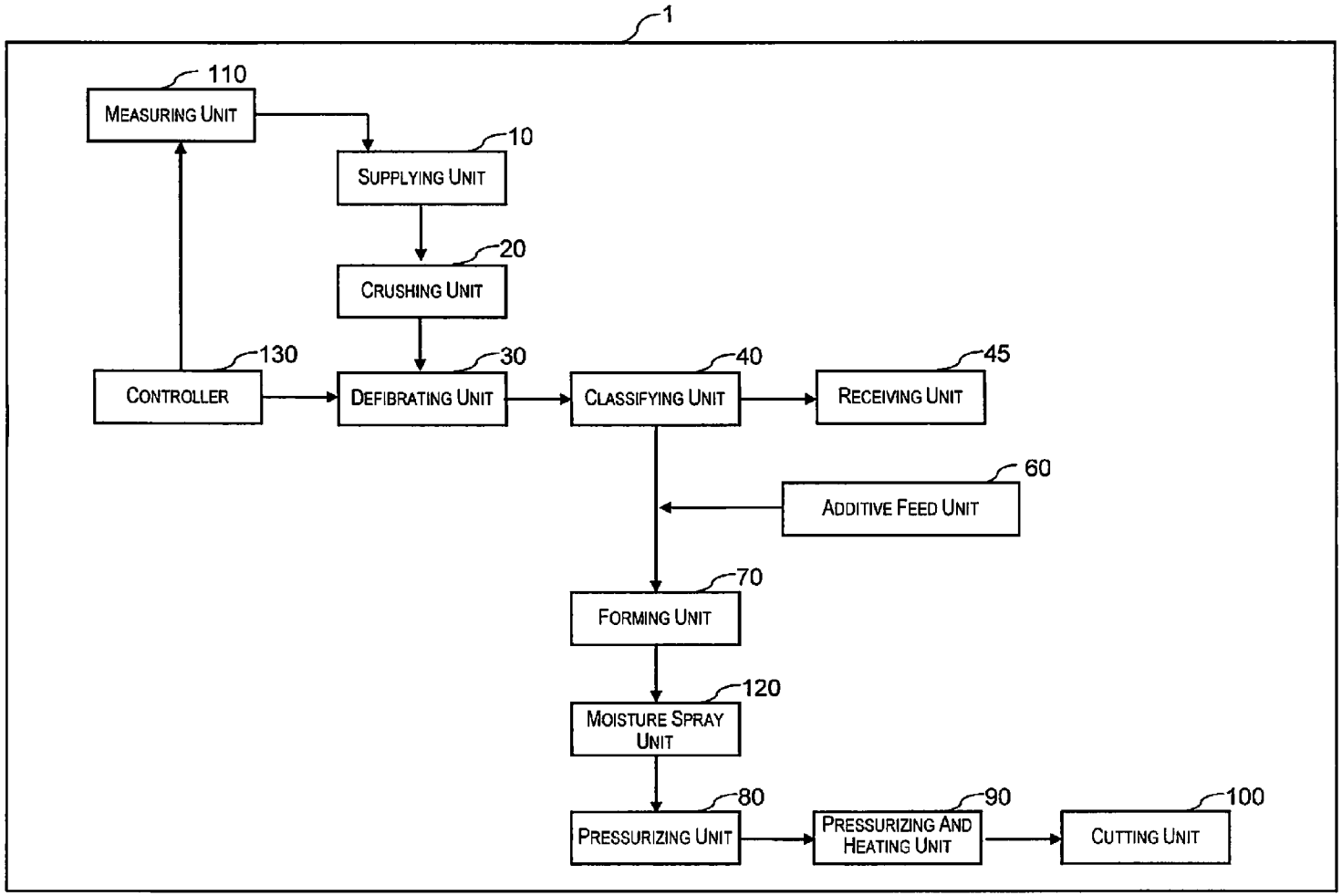
FIG. 1 is a schematic view illustrating the configuration of a sheet manufacturing apparatus as in a first embodiment.
Figure 2:
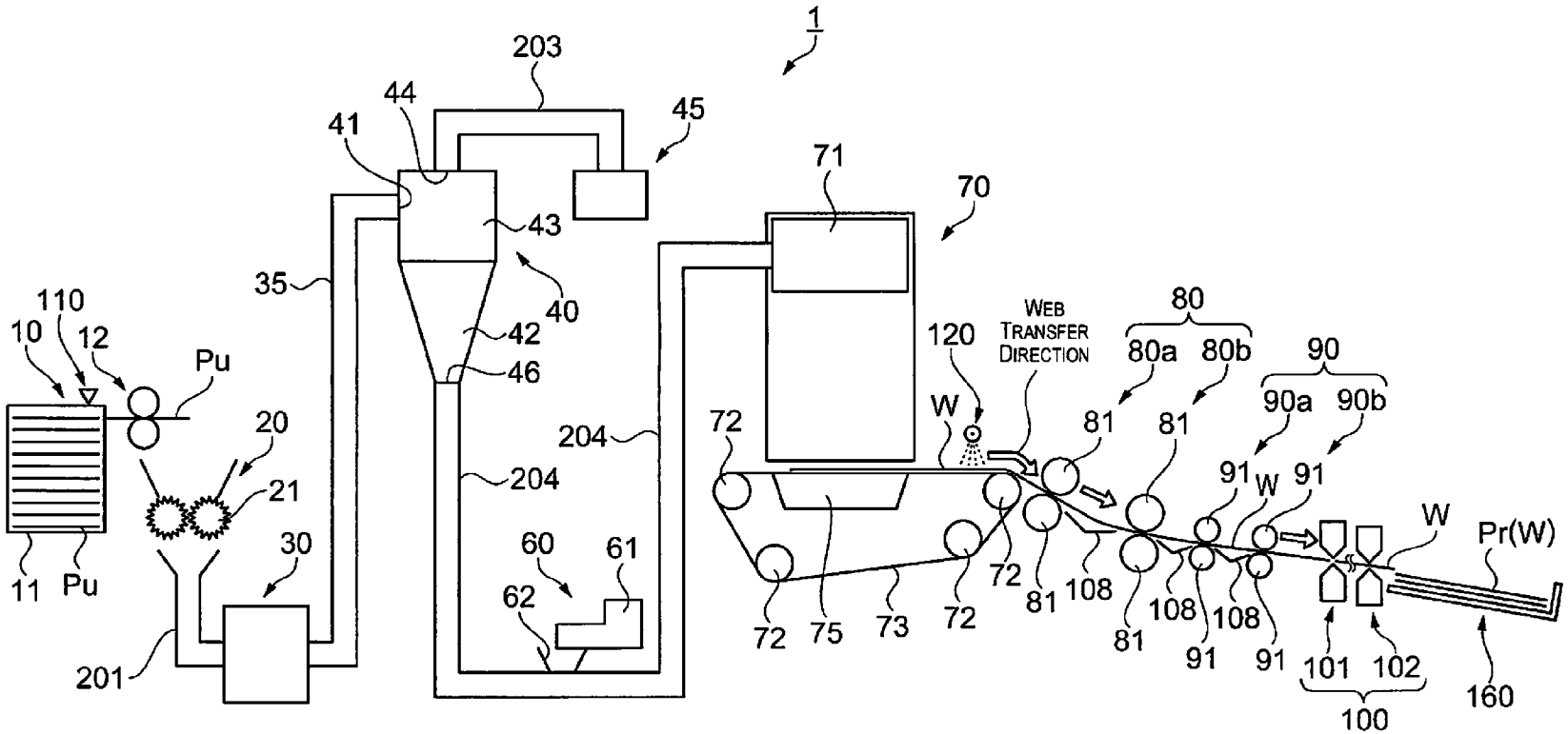
FIG. 2 is a different schematic view illustrating the configuration of a sheet manufacturing apparatus as in the first embodiment.

FIGS. 1 and 2 are schematic views illustrating the configuration of a sheet manufacturing apparatus. As illustrated in FIGS. 1 and 2, a sheet manufacturing apparatus 1 is provided with a supplying unit 10, a crushing unit 20, a defibrating unit 30, a classifying unit 40, a receiving unit 45, an additive feed unit 60, a forming unit 70, a moisture spray unit 120, a pressurizing unit 80, a pressurizing and heating unit 90, and a cutting unit 100. The sheet manufacturing apparatus 1 is further provided with a measuring unit 110 for acquiring information relating to the moisture contained in the defibration object. The sheet manufacturing apparatus 1 is also provided with a controller 130 for controlling these members.

The supplying unit 10 is for supplying a stock material serving as the defibration object to the crushing unit 20. The supplying unit 10 is provided, for example, with a tray 11 on which a plurality of a stock material Pu is loaded, an automatic feeding mechanism 12 with which the stock material Pu placed onto the tray 11 can be continuously fed to the crushing unit 20, and so forth.

Herein, the measuring unit 110 is arranged in the supplying unit 10. The measuring unit 110 is for acquiring information relating to the moisture of the stock material Pu serving as the defibration object being supplied. The configuration is such that an operating condition of the defibrating unit 30 is controlled by the controller 130 on the basis of the acquired information relating to the moisture of the stock material Pu. Examples of the information relating to the moisture include the water content ratio, the moisture amount, and so forth.

A variety of sensors could be applied as the measuring unit 110. For example, a moisture meter of a non-contact infrared format could be used. In addition, it would also be possible to use an electrical resistance format, a microwave format, or the like. In the case of a contact type, there is the possibility that measurements could experience a variance due to the attachment of paper dust or the like to a sensor part, and cleaning and other forms of maintenance happen more frequently; therefore, a non-contact-type infrared format or microwave format is more desirable, but a selection can be made as appropriate depending on cost and device size.

The crushing unit 20 is for cutting the supplied stock material Pu into pieces that are several centimeters square. In the crushing unit 20, crushing blades 21 are provided, to constitute such a device as to broaden the cutting width of blades in an ordinary shredder. This makes it possible to easily cut the supplied stock material Pu into pieces. The pieces are supplied to the defibrating unit 30 by way of a piping 201.

The defibrating unit 30 is provided with a rotating blade that rotates, and is for defibrating the pieces supplied from the crushing unit 20 into a fibrous (linear) shape. The defibrating unit 30 of the present embodiment is not defibration in water but rather is a dry-type defibration for defibrating in air. For the defibrating unit 30, it would be possible to apply, for example, a dry-type defibration device provided with a wind generation mechanism, a disc refiner, a Turbo-Mill (made by Turbo Kogyo Co., Ltd.), or a Ceren-Miller (made by Masuko Sangyo Co., Ltd.), as appropriate. The size of the pieces that are fed into the dry-type defibrating unit 30 of such description should be a size that is discharged from an ordinary shredder.

The defibration process of the defibrating unit 30 causes any printed ink or toner, materials with which the stock material is coated such as anti-blotting agents, or the like to also be released from a state of having attached to the fibers (henceforth called "ink particles"). As such, defibrated material that is discharged from the defibrating unit 30 is fibers and ink particles obtained by defibrating the pieces. The rotation of the rotating blade results in a mechanism with which an airflow occurs, and the defibrated fibers are borne by this airflow and transported to the classifying unit 40 by way of a piping 35. In a case where a dry-type defibrating unit 30 not provided with a wind generation mechanism is used, an airflow generation device for generating an airflow toward the defibrating unit 30 from the crushing unit 20 should be separately provided.

The classifying unit 40 is for classifying the transported defibrated material into ink particles and fibers, and removing the ink particles. A cyclone 40 is applied as the classifying unit 40 of the present embodiment. Instead of the cyclone 40, another type of airflow-type sorter may be utilized, however. In such a case, for example, an elbow jet, eddy classifier, or the like is used as an airflow-type sorter other than the cyclone 40. An airflow-type sorter is for generating a swirling airflow, and separating and classifying by using differences in the centrifugal force received because of the size and density of the defibrated material, and allows for the classifying points to be adjusted by adjusting the airflow speed and centrifugal force.

For the cyclone 40, a cyclone of a tangential input format has a relatively simple structure and is preferable. The cyclone 40 of the present embodiment is constituted of an introduction port 41 through which [the defibrated material] is introduced from the defibrating unit 30, a cylindrical portion 43 to which the introduction port 41 leads in a tangential direction, a conical part 42 continuous with the cylindrical portion 43, a lower ejector port 46 provided to a lower part of the conical part 42, and an upper exhaust port 44 for discharging a fine powder, the upper exhaust port being provided to an upper middle of the cylindrical portion 43.

In a classification process, the airflow bearing the defibrated material introduced from the introduction port 41 of the cyclone 40 changes to a circumferential movement in the cylindrical portion 43, and moves toward the conical part 42. The defibrated material is separated and classified by differences in the centrifugal force received because of the size and density thereof. In a case where what is contained in the defibrated material is given the two classifications of either fibers or ink particles other than fibers, then the fibers are either larger or denser than the ink particles. For this reason, the classification process causes the defibrated material to be separated into: the ink particles, which are smaller and less dense than the fibers; and the fibers, which are larger and denser than the ink particles. The separated ink particles are introduced to the upper exhaust port 44 as fine powder, along with air. The comparatively smaller and less dense ink particles are discharged from the upper exhaust port 44 of the cyclone 40. The ink particles thus discharged are recovered at the receiving unit 45 by way of a piping 203 from the upper exhaust port 44 of the cyclone 40. The fibers larger and denser than the ink particles, however, are transported toward the forming unit 70 from the lower ejector port of the cyclone 40 as defibrated fibers.

The additive feed unit 60, which adds an additive to the defibrated fibers, is provided to midway on a piping 204, via which the defibrated fibers are transported to the forming unit 70 from the cyclone 40. Possible examples of additives include a fusion-bondable resin, a flame retardant, a whiteness enhancer, a paper strengthener, or a sizing agent, and so forth. These added materials may be partially or entirely omitted, or other additives may be fed in. An added agent is stored in a storing unit 61 and is fed in from a feeding port 62 by a feed mechanism (not shown).

The defibrated fibers, into which the added agent has been mixed, are then used to form a sheet. The defibrated fibers into which a fusion-bondable resin or added agent has been mixed are therefore also called material fibers.

The forming unit 70 is for causing the material fibers to deposit at a uniform thickness. The forming unit 70 has a mechanism for causing the material fibers to be evenly dispersed into the air, and a mechanism for suctioning the material fibers onto a mesh belt.

First, a forming drum 71 with which the material fibers are fed into the interior is arranged in the forming unit 70 as the mechanism for causing the material fibers to be evenly dispersed into the air. Rotating enables the forming drum 71 to evenly mix the added agent into the fibers. A porous screen is provided to the surface of the forming drum 71. Rotatingly driving the forming drum 71 and causing the material fibers to pass through the porous screen makes it possible to cause the material fibers to be evenly dispersed into the air.

In turn, an endless mesh belt 73 on which a mesh is formed is disposed vertically below the forming drum 71. The mesh belt 73 is stretched over a plurality of stretch rollers 72, and is made to move in one direction by spinning of at least one of the stretch rollers 72.

A suction device 75 for generating an airflow oriented vertically downward is provided to vertically below the forming drum 71, with the mesh belt 73 interposed therebetween. The suction device 75 makes it possible to suction the material fibers, which have been dispersed into the air, onto the mesh belt 73.

When the material fibers are introduced to inside the forming drum 71 of the forming unit 70, the material fibers pass through the porous screen of the surface of the forming drum 71 and are deposited onto the mesh belt 73 by the suction force coming from the suction device 75. At this time, causing the mesh belt 73 to move in one direction makes it possible to cause the material fibers to deposit at an even thickness. Deposited matter which comprises the material fibers that have deposited in this manner is called a web W. The mesh belt may be made of a metal, a resin, or a nonwoven fabric, and is not particularly limited provided that the material fibers can be deposited and an airflow can be passed therethrough. However, when the hole diameter of the mesh is too large, the sheet becomes uneven when formed, and when the hole diameter of the mesh is too small, it is difficult to form a stabilized airflow coming from the suction device 75. The hole diameter of the mesh is therefore preferably adjusted as appropriate.

The suction device 75 can be formed by forming an enclosed box in which a window of a desired size is opened below the mesh belt 73, and suctioning out the air inside the box from outside the window to make a vacuum inside the box.

The web W is transported in a web transfer direction, illustrated with arrows in FIG. 2, by movement of the mesh belt 73. The moisture spray unit 120 is for spraying and thereby adding moisture toward the web W being transported. This makes it possible to strengthen the hydrogen bonds between the fibers. The web W onto which the moisture has been sprayed is then transported to the pressurizing unit 80.

The pressurizing unit 80 is for applying a pressure to the transported web W. The pressurizing unit 80 is provided with two pairs of compressor rollers 81. The web W onto which the moisture has been sprayed is made to pass between the mutually opposing compressor rollers 81, whereby the web W is compressed. The compressed web W is then transported to the pressurizing and heating unit 90.

The pressurizing and heating unit 90 is for simultaneously applying pressure and heat to the transported web W. The pressurizing and heating unit 90 is provided with two pairs of heater rollers 91. The compressed web W is made to pass through the mutually opposing heater rollers 91, whereby heat and pressure are both applied.

The compressor rollers 81 have shortened the spacing between fibers and increased the points of contact between fibers, and in this state the heater rollers 91 cause the fusion-bondable resin to melt, thus binding the fibers to one another. This makes it possible to improve the strength as a sheet and, by drying out the surplus moisture, makes it possible to manufacture excellent sheets. With the heating, preferably the pressure and the heat are applied at the same time to the web W, by installing a heater inside of the heater rollers 91. Guides 108 for guiding the web W are arranged below the compressor rollers 81 and the heater rollers 91.

The sheet (web W) obtained in the manner described above is transported to the cutting unit 100. The cutting unit 100 is provided with a cutter 101 for cutting in the transport direction and a cutter 102 for cutting in a direction orthogonal to the transport direction, and cuts the sheet, which has been formed in an elongated shape, into a desired size. The cut sheets Pr (web W) are stacked onto a stacker 160.

Figure 3:
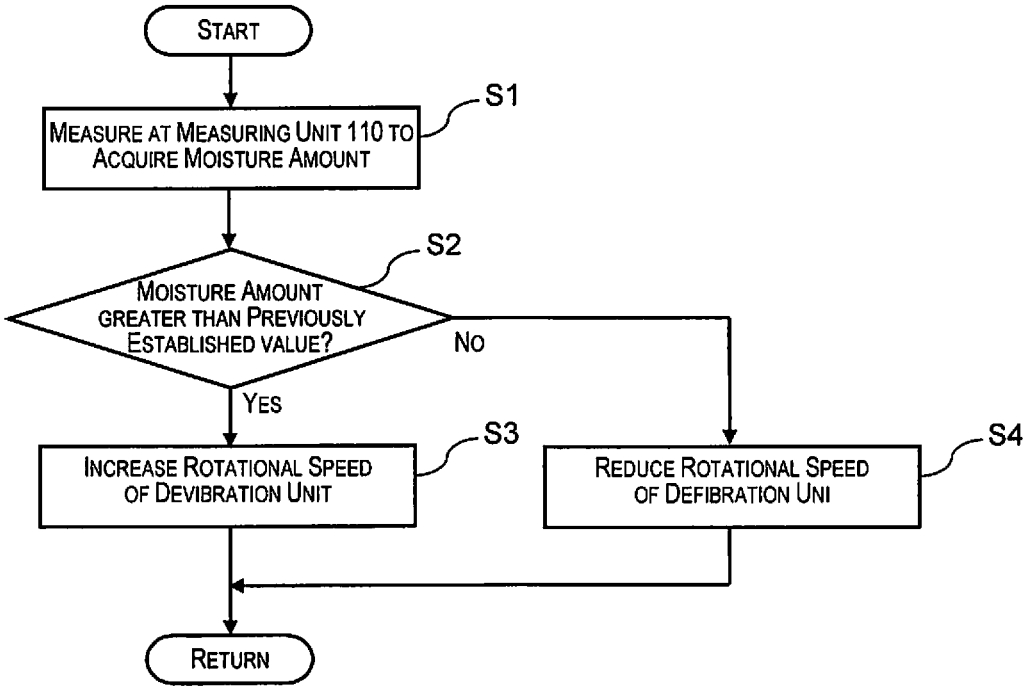
FIG. 3 is a flow chart illustrating a control as in the first embodiment.

Next, a method of controlling the sheet manufacturing apparatus shall be described. More specifically, a method of controlling shall be described in which an operating condition of the defibrating unit 30 is controlled in accordance with the moisture amount, which serves as the information relating to the moisture contained in the defibration object. FIG. 3 is a flow chart illustrating the control as in the first embodiment.

Firstly, the moisture amount of the stock material (used paper) serving as the defibration object is acquired. In the present embodiment, the measuring unit 110 installed in the supplying unit 10 is driven and the moisture amount contained in the stock material is acquired (step S1).

Next, an operating condition of the defibrating unit 30 is modified on the basis of the acquired moisture amount of the stock material. More specifically, a determination is made as to whether or not the moisture amount contained in the stock material is greater than a previously established value (step S2). The operating condition of the defibrating unit 30 is selected from two conditions where the rotational speed of the rotating blade of the defibrating unit 30 is either high or low.

In a case where the moisture amount contained in the stock material is greater than the previously established value (step S2: YES), then the rotating blade of the defibrating unit 30 is rotated at a high rotational speed (step S3). In a case where the moisture amount contained in the stock material is greater than the previously established value, then the fibers are more likely to become entangled with one another, and fiber clumping (masses of fiber) is more likely to take place. Therefore, increasing the rotational speed of the defibrating unit 30 causes the stock material to be more defibrated, because the number of times where the rotating blade hits against the stock material is increased in the defibrating unit 30. The occurrence of fiber clumping is also reduced.

In turn, in a case where the moisture amount contained in the stock material is less than the previously established value (step S2: NO), then the rotating blade of the defibrating unit 30 is rotated at low rotational speed (step S4). Should the defibrating unit 30 be rotated at high rotational speed in a case where the moisture amount contained in the stock material is less than the previously established value, then there would be too much defibration, there would be a greater proportion of short fibers, and the strength of the sheets when produced would be inadequate. Therefore, lowering the rotational speed of the defibrating unit 30 reduces the number of times where the rotating blade hits against the stock material in the defibrating unit 30 and therefore reduces the efficiency of defibration of the stock material. This eliminates a state of excessive defibration and also reduces the occurrence of short fibers.

Having the rotational speed of the defibrating unit 30 change causes the pressure that is applied to the stock material while the stock material passes through the defibrating unit 30 to also change. The pressure applied to the stock material increases in a case where the rotational speed of the defibrating unit 30 increases and the pressure applied to the stock material decreases in a case where the rotational speed of the defibrating unit 30 is reduced.

In the control in FIG. 3, the determination made is divided between two cases, where the moisture amount is either greater or lower than the previously established value. There is no limitation thereto, and a plurality of threshold values may be set and the determination made may be divided between three or more cases. In both a case divided between two cases and a case divided between three or more cases, the rotational speed of the rotating blade (pressure) for when the moisture amount contained in the defibration object (stock material) is in a first case will be greater than the rotational speed of the rotating blade (pressure) for when the moisture amount contained in the defibration object is less than the first case.

According to the embodiment above, the following effects can be obtained.

(1) The moisture amount of the stock material being fed in to the sheet manufacturing apparatus 1 is measured by the measuring unit 110. Then, for example, the rotational speed of the rotating blade of the defibrating unit 30 is raised in a case where the moisture amount contained in the stock material is greater than the previously established value. This causes the stock material to be more defibrated and also reduces the occurrence of fiber clumping, because the number of times where the rotating blade hits against the stock material is increased in the defibrating unit 30. This reduces fiber clumping and makes it possible to produce high-quality sheets that do not have surface unevenness. In turn, the rotational speed of the rotating blade of the defibrating unit 30 is lowered in a case where the moisture amount contained in the stock material is less than the previously established value. This lowers the efficiency of defibration for the stock material and eliminates excessive defibration, because the number of times where the rotating blade hits against the stock material is reduced in the defibrating unit 30. This reduces short fibers and makes it possible to product sheets with which strength has been ensured.

Second Embodiment

Figure 4:
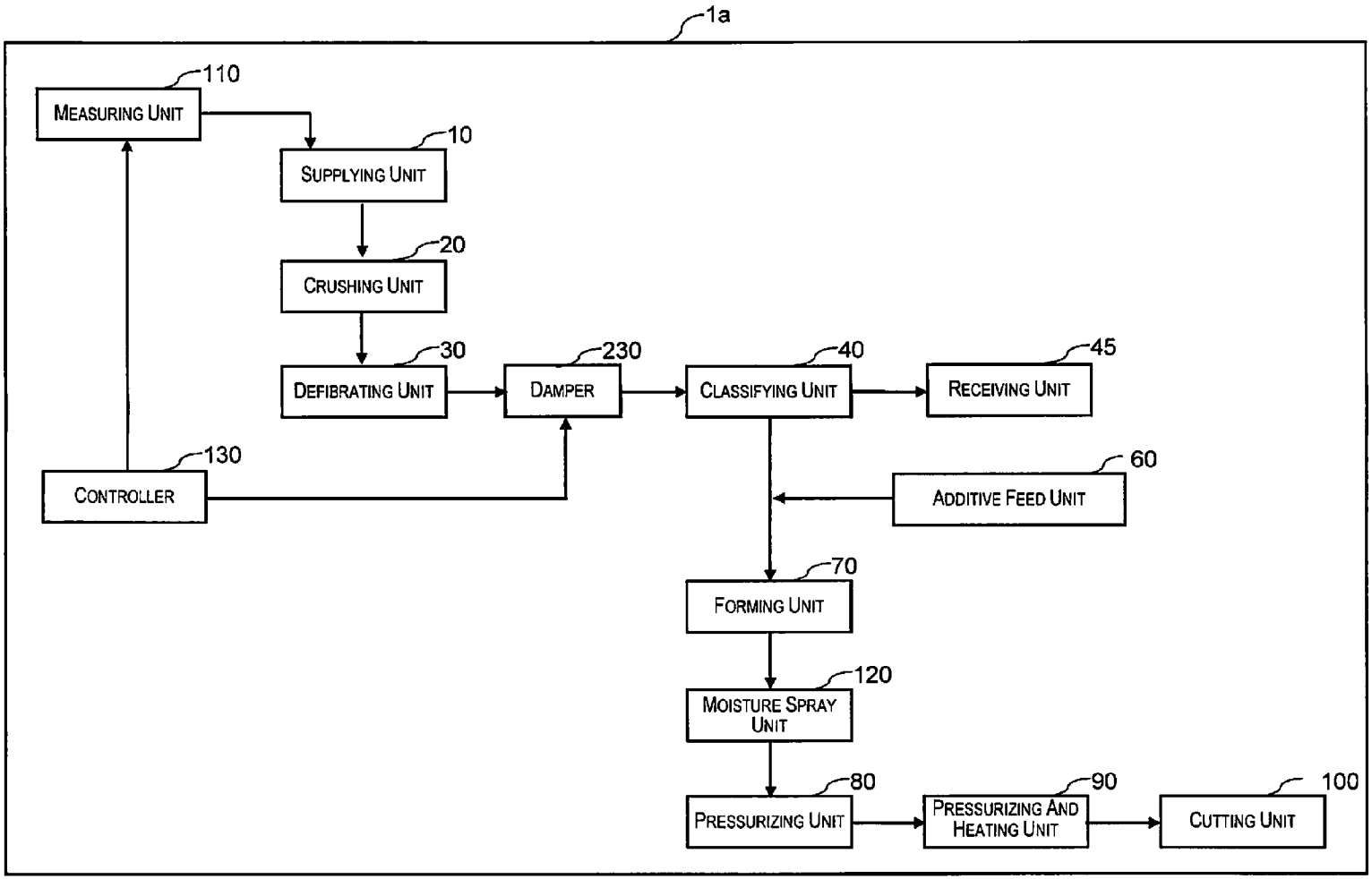
FIG. 4 is a schematic view illustrating the configuration of a sheet manufacturing apparatus as in a second embodiment.
Figure 5:
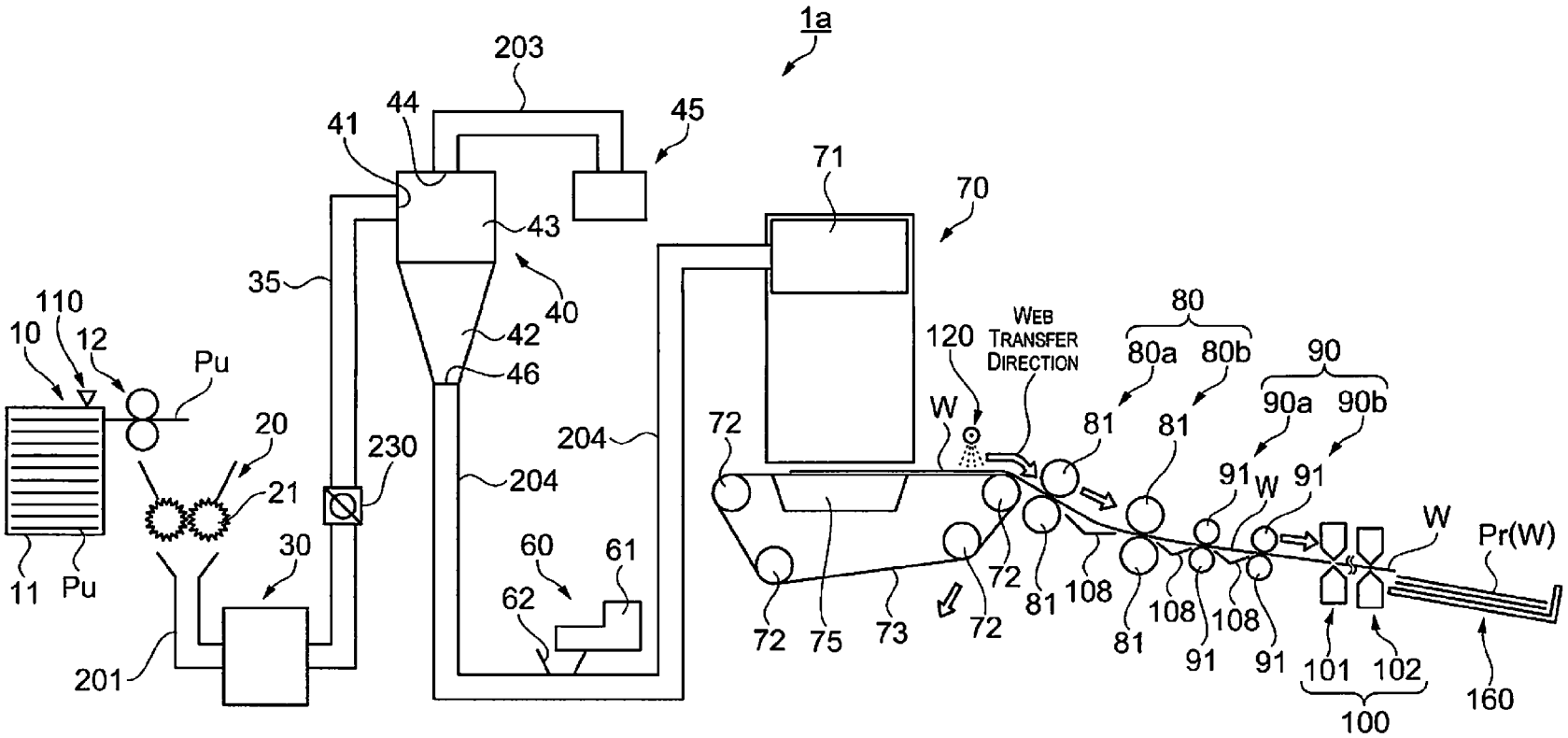
FIG. 5 is a different schematic view illustrating the configuration of a sheet manufacturing apparatus as in the second embodiment.

First, the configuration of a sheet manufacturing apparatus shall be described. FIGS. 4 and 5 are schematic views illustrating the configuration of a sheet manufacturing apparatus as in the present embodiment. As illustrated in FIGS. 4 and 5, a sheet manufacturing apparatus 1*a* is provided with a supplying unit 10, a crushing unit 20, a defibrating unit 30, a classifying unit 40, a receiving unit 45, an additive feed unit 60, a forming unit 70, a moisture spray unit 120, a pressurizing unit 80, a pressurizing and heating unit 90, and a cutting unit 100.

The sheet manufacturing apparatus 1*a* is further provided with a measuring unit 110 for acquiring information relating to the moisture contained in the defibration object. A damper 230 is also provided to midway on the piping 35 by which the defibrating unit 30 and the classifying unit 40 are connected. The sheet manufacturing apparatus 1*a* is also provided with a controller 130 for controlling these members. The configuration other than the damper 230 is similar to the configuration in the first embodiment, and a description is therefore omitted here.

The damper 230 is for adjusting an exhaust amount that is exhausted toward the classifying unit 40 from the defibrating unit 30. Causing the rate of opening of the damper 230 to change makes it possible to adjust the exhaust amount. For example, a butterfly damper or the like can be used as the damper 230, and restricting the exhaust amount coming from the defibrating unit 30 makes it possible to elevate the static pressure of the defibrating unit 30 interior and to promote defibration. Increasing the exhaust amount coming from the defibrating unit 30 also makes it possible to reduce the static pressure of the defibrating unit 30 interior and to restrict defibration.

For example, when the rate of opening of the damper 230 is increased, then it is possible to increase (the quantity of) the exhaust amount coming from the defibrating unit 30. In a case where the exhaust amount coming from the defibrating unit 30 is large, then the extent of defibration in the defibrating unit 30 is lower, because the defibrated material in the defibrating unit 30 interior is retained for a briefer period of time.

In turn, when the rate of opening of the damper 230 is reduced, then the exhaust amount coming from the defibrating unit 30 can be reduced (restricted). In a case where the exhaust amount coming from the defibrating unit 30 is low, then the extent of defibration in the defibrating unit 30 is higher, because the defibrated material in the defibrating unit 30 interior is retained for a longer period of time.

Next, a method for controlling the sheet manufacturing apparatus shall be described. As a method for controlling the sheet manufacturing apparatus 1*a*, first, the moisture amount of the stock material (used paper) serving as the defibration object is acquired. FIG. 6 is a flow chart illustrating the control as in the second embodiment. In the present embodiment, the measuring unit 110 installed in the supplying unit 10 is driven and the moisture amount contained in the stock material is acquired (step S11).

Next, an operating condition of the defibrating unit 30 is modified on the basis of the acquired moisture amount of the stock material. More specifically, a determination is made as to whether or not the moisture amount contained in the stock material is greater than a previously established value (step S12). The operating condition of the defibrating unit 30 is selected from the two conditions of whether the speed at which the defibrated material passes through the defibrating unit 30 is high or low. In a case where the moisture amount contained in the stock material is greater than the previously established value (step S12: YES), then the speed at which the defibrated material passes through the defibrating unit 30 is lowered (step S13). In a case where the moisture amount contained in the stock material is greater than the previously established value, then the fibers are more likely to become entangled with one another, and fiber clumping (masses of fiber) is more likely to take place. Therefore, lowering the speed of the defibrated material passing through the defibrating unit 30 causes the stock material to be more defibrated, because the number of times where the rotating blade hits against the stock material is increased in the defibrating unit 30. The occurrence of fiber clumping is also reduced. The control for lowering the speed of the defibrated material passing through the defibrating unit 30 is more specifically to reduce the rate of opening of the damper 230.

In turn, in a case where the moisture amount contained in the stock material is less than the previously established value (step S12: NO), then the speed of the defibrated material passing through the defibrating unit 30 is increased (step S14). Should the speed of the defibrated material passing through the defibrating unit be reduced in a case where the moisture amount is small, then there would be too much defibration, there would be a greater proportion of short fibers, and the strength of the sheets when produced would be inadequate. Therefore, increasing the speed of the defibrated material passing through the defibrating unit 30 reduces the number of times where the rotating blade hits against the stock material in the defibrating unit 30 and therefore reduces the efficiency of defibration of the stock material. This eliminates a state of excessive defibration and also reduces the occurrence of short fibers. The control for increasing the speed of the defibrated material passing through the defibrating unit 30 is more specifically to increase the rate of opening of the damper 230.

Having the speed of the defibrated material passing through the defibrating unit 30 change causes the pressure that is applied to the stock material while the stock material passes through the defibrating unit 30 to also change. The pressure applied to the stock material increases in a case where the speed of the defibrated Material passing through the defibrating unit 30 is lowered, and the pressure applied to the stock material decreases in a case where the speed of the defibrated material passing through the defibrating unit 30 is increased.

In the control in FIG. 6, the determination made is divided between two cases, where the moisture amount is either greater or lower than the previously established value. There is no limitation thereto, and a plurality of threshold values may be set and the determination made may be divided between three or more cases. In both a case divided between two cases and a case divided between three or more cases, the speed at which the stock material passes through the defibrating unit 30 (pressure) for when the moisture amount contained in the defibration object (stock material) is in a first case will be greater than the speed at which the stock material passes through the defibrating unit 30 (pressure) for when the moisture amount contained in the defibration object is less than the first case.

According to the second embodiment above, the following effects can be obtained.

(1) The moisture amount of the stock material being fed in to the sheet manufacturing apparatus 1*a* is measured by the measuring unit 110. Then, for example, the rate of opening of the damper 230 is reduced in a case where the moisture amount contained in the stock material is greater than the previously established value. This causes the stock material to be more defibrated and reduces the occurrence of fiber clumping, because the stock material passes through at a lower speed in the defibrating unit 30 and the number of times where the rotating blade hits against the stock material is increased. This reduces fiber clumping and makes it possible to produce high-quality sheets that do not have surface unevenness. In turn, the rate of opening of the damper 230 is increased in a case where the moisture amount contained in the stock material is less than the previously established value. This lowers the efficiency of defibration for the stock material and eliminates excessive defibration, because the stock material passes through at a greater speed in the defibrating unit 30 and the number of times where the rotating blade hits against the stock material is reduced. This reduces short fibers and makes it possible to product sheets with which strength has been ensured.

First Example

Next, a first example shall be described. FIG. 7 is a drawing illustrating a state of defibration as in the first example. More specifically, FIG. 7 illustrates the circumstances of defibrated material (whether or not short fibers occur and whether or not fiber clumping occurs) in cases where four different kinds of changes are made to the rotational speed of the rotating blade of the defibrating unit 30, in accordance with four different kinds of water content ratio contained in the stock material being fed in. In the drawing, the symbol "○" is indicative of the fact that neither short fibers nor fiber clumping occurred and favorable paper was obtained.

As illustrated in FIG. 7, favorable paper was obtained in cases where the water content ratio of the stock material was low and the rotational speed of the rotating blade of the defibrating unit 30 was low. In turn, defibration became excessive and short fibers occurred in cases where the water content ratio of the stock material was low and the rotational speed of the rotating blade of the defibrating unit 30 was high.

Favorable paper was further obtained in cases where the water content ratio of the stock material was high and the rotational speed of the rotating blade of the defibrating unit 30 was high. In turn, fiber clumping tended to occur in cases where the water content ratio of the stock material was high and the rotational speed of the rotating blade of the defibrating unit 30 was low.

In this manner, the circumstances of occurrence of fiber clumping and circumstances of occurrence of short fibers depended on the water content ratio of the stock material, but controlling the rotational speed of the rotating blade of the defibrating unit 30, i.e., regulating the intensity of defibration makes it possible to avoid such difficulties.

That is to say, the static pressure of the defibrating unit 30 interior is elevated when the rotational speed of the rotating blade is raised. This leads to circumstances where eddying flows created by the rotating blade have a higher static pressure and the stock material fibers inside the defibrating unit 30 are more intensely defibrated. Conversely, lowering the rotational speed of the rotating blade reduces the static pressure of the defibrating unit 30 interior and therefore lowers the intensity of defibration. It is possible to make use of this property and regulate the intensity of the extent of defibration of the stock material fibers.

More specifically, a case where the rotational speed of the rotating blade of the defibrating unit 30 is controlled depending on whether the water content ratio of the stock material is greater than or less than 6.0% shall be described.

As illustrated in FIG. 7, the defibrating unit 30 should rotate at a rotational speed of 3,000 rpm in a case where the water content ratio is less than 6.0%, and the defibrating unit 30 should rotate at a rotational speed of 4,000 rpm in a case where the water content ratio is greater than 6.0%.

A case where the determination made is divided not into two cases but rather into four cases shall also be described.

As illustrated in FIG. 7, the defibrating unit 30 should rotate at a rotational speed of 2,000 rpm in a case where the water content ratio is about 4.2%. Likewise, rotation should be at 3,000 rpm, 4,000 rpm, and 5,000 rpm in a case where the water content ratio is about 5.1%, about 6.8%, and about 8.0%, respectively.

A specific example of criteria for fiber clumping and short fibers shall be illustrated here.

Fiber clumping is determined to have occurred by visually checking the fibers after defibration. It has been confirmed that a granular unevenness occurs on the surface of recycled paper when paper is formed at conditions under which clumping has been actually been visually confirmed in fibers after defibration.

Short fibers are determined to have occurred by visually checking the fibers after defibration. The paper strength has been confirmed to be low when paper is formed at conditions under which short fibers have actually been visually confirmed in fibers after defibration. Paper strength here is determined on the basis of the tensile strength of paper as measured by Shimadzu's "Universal testing machine autograph". Ordinarily, the pulp fiber length of paper is about 0.7 to 0.8 mm, and the tensile strength in such cases is about 15 to 25 MPa. By contrast, the pulp fiber length ends up being as short as about 0.4 to 0.6 mm when defibration is excessive, and the tensile strength in such a case is 10 to 15 MPa, reaching a state where the tensile strength is not adequate for ordinary paper.

According to the description above, modifying an operating condition of the defibrating unit 30 (the rotational speed of the rotating blade of the defibrating unit 30) in accordance with the water content ratio of the stock material being fed to the defibrating unit 30 makes it possible to eliminate the occurrence of fiber clumping and form sheets that have a favorable surface condition, and at the same time makes it possible to form sheets with which an ample tensile strength of the sheets has been upheld.

Second Example

Next, a second example be described. FIG. 8 is a drawing illustrating a state of defibration as in the second example. More specifically, the circumstances of defibrated material (whether or not short fibers occur and whether or not fiber clumping occurs) in a case where four different changes are made to the rate of opening of the damper 230 in accordance with four water content ratios contained in the stock material are illustrated. In the drawing, the symbol "○" is indicative of the fact that neither short fibers nor fiber clumping occurred and favorable sheets were obtained.

As illustrated in FIG. 8, favorable paper was obtained in a cases where the water content ratio of the stock material was low and the rate of opening of the damper 230 was high. In turn, defibration became excessive and short fibers occurred in cases where the water content ratio of the stock material was low and the rate of opening of the damper 230 was low. Favorable paper was also obtained in cases where the water content ratio of the stock material was high and the rate of opening of the damper 230 was low. In turn, fiber clumping tended to occur in cases where the water content ratio of the stock material was high and the rate of opening of the damper 230 was high. In this manner, the circumstances of occurrence of fiber clumping and circumstances of occurrence of short fibers depended on the water content ratio of the stock material, but controlling the rate of opening of the damper 230, i.e., regulating the speed at which the defibrated fibers pass through the defibrating unit 30 (regulating the intensity of the extent of defibration of the stock material fibers) makes it possible to avoid such difficulties.

That is to say, the static pressure of the defibrating unit 30 interior will be elevated when the rate of opening of the damper 230 is reduced. This leads to circumstances where eddying flows created by the rotating blade have a higher static pressure and the stock material fibers inside the defibrating unit 30 are more intensely defibrated. Conversely, increasing the rate of opening of the damper 230 reduces the static pressure of the defibrating unit 30 interior and therefore lowers the intensity of defibration. It is possible to make use of this property and regulate the intensity of the extent of defibration of the stock material fibers.

More specifically, a case where the rate of opening of the damper 230 is controlled depending on whether the water content ratio of the stock material is greater than or less than 6.0% shall now be described.

As illustrated in FIG. 8, the rate of opening of the damper 230 should be set to 100% in a case where the water content ratio is less than 6.0%, and the rate of opening of the damper 230 should be set to 10% in a case where the water content ratio is greater than 6.0%.

A case where the determination made is divided not into two cases but rather into four cases shall also be described.

As illustrated in FIG. 8, the rate of opening of the damper 230 should be set to 100% in a case where the water content ratio is about 4.2%. Likewise, the rate of opening should be set to 70%, 40%, and 10% in a case where the water content ratio is about 5.1%, about 6.8%, or about 8.0%, respectively.

The criteria for fiber clumping and short fibers are similar to those in the first example, and a description thereof is therefore omitted here.

According to the description above, modifying the exhaust amount coming from the defibrating unit 30 in accordance with the water content ratio of the stock material being fed to the defibrating unit 30 makes it possible to eliminate the occurrence of fiber clumping and form recycled sheets that have a favorable surface condition, and at the same time makes it possible to form recycled sheets with which an ample tensile strength of the sheets has been upheld.

The present invention is not limited to the embodiments and examples described above, but rather a variety of modifications, improvements, or the like could be made to the embodiments and examples described above. Modification examples shall be described below.

In the first and second embodiments, information about the moisture amount of the stock material was acquired by the measuring unit 110 and the operating conditions of the defibrating unit 30 were controlled on the basis of the acquired information, but there is no limitation to this configuration. For example, an outside air sensor for acquiring information about the status of outside air near the sheet manufacturing apparatus 1 or 1*a* may be provided, the operating condition of the defibrating unit 30 then being controlled on the basis of the status of outside air (temperature, humidity, or the like) acquired by the outside air sensor. In this manner, the defibrating unit 30 can be easily controlled in accordance with the circumstances of outside air or circumstances of arrangement of the sheet manufacturing apparatus 1 or 1*a*. The outside air sensor may be applied as an alternative for the measuring unit 110 or may be used in combination with the measuring unit 110. The first embodiment and second embodiment described cases where information about the moisture amount was acquired, and the first example and second example described cases where information about the water content ratio was acquired. In a case where the water content ratio contained in the stock material Pu is high, there will also be a large moisture amount contained in the stock material Pu. For this reason, regardless of whether the information acquired is the water content ratio or the moisture amount, both allow for comparison as the moisture amount contained in the stock material Pu.

The "sheets" as in the embodiments described above refer primarily to things that contain fibers, such as used paper and pure pulp, and are used as a stock material to make sheets. However, there is no limitation to being thus, and the shape may be that of a board or webbing, or may be an uneven shape. The stock material may also be cellulose or other plant fibers, polyethylene terephthalate (PET), polyester, or other chemical fibers, or wool, silk, or other animal fibers. In the present application, the "sheets" would be divided in paper and nonwoven fabrics. Paper encompasses forms made into thin sheets and the like, and encompasses recording paper intended for writing or printing, or wallpaper, wrapping paper, colored paper, Kent paper, and the like. Nonwoven fabrics are thinner and have less strength than paper, and encompass nonwoven fabrics, fiber board, tissue paper, kitchen paper, cleaners, filters, liquid-absorbing materials, sound-absorbing materials, mats, and the like.

In the second embodiment, the speed of the defibrated material passing through the defibrating unit 30 was controlled by changing the rate of opening of the damper 230. There is no limitation thereto, and the speed of the defibrated material passing through the defibrating unit 30 may be controlled by providing a blower to further upstream than the defibrating unit 30 and controlling the airflow speed of the blower.

In the embodiments described above, the words "even[ly]", "circular", and so forth encompass error and accumulation of error, and need not be completely even or perfectly circular.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus comprising:

a defibrating unit configured to defibrate a defibration object;

a measuring unit configured to acquire information relating to moisture contained in the defibration object to be defibrated at the defibrating unit; and a controller configured to modify an operating condition of the defibrating unit based on the information acquired by the measuring unit.

2. The sheet manufacturing apparatus according to claim 1, wherein the defibrating unit has a rotating blade configured to defibrate the defibration object, and the controller controls the defibrating unit such that a pressure applied to the defibration object while the defibration object passes through the defibrating unit and when the moisture amount contained in the defibration object is a first case is greater than a pressure applied to the defibration object while the defibration object passes through the defibrating unit and when the moisture amount contained in the defibration object is less than the first case.

3. The sheet manufacturing apparatus according to claim 2, wherein the controller controls the defibrating unit such that a rotational speed of the rotating blade when the moisture amount contained in the defibration object is the first case is greater than a rotational speed of the rotating blade when the moisture amount contained in the defibration object is less than the first case.

4. The sheet manufacturing apparatus according to claim 2, wherein the controller controls the defibrating unit such that a speed at which the defibration object passes through the defibrating unit when the moisture amount contained in the defibration object is the first case is less than a speed at which the defibration object passes through the defibrating unit when the moisture amount contained in the defibration object is less than the first case.

* * * * *